United States Patent [19]

Gorran

[11] 3,983,587

[45] Oct. 5, 1976

[54] WHEEL OR GERIATRICS CHAIR CUSHION

[76] Inventor: Jody A. Gorran, 289A S. 11th Ave., Highland Park, N.J. 08904

[22] Filed: Sept. 23, 1975

[21] Appl. No.: 616,045

[52] U.S. Cl. ..... 5/338; 5/371; 5/370

[51] Int. Cl.[2] ..... A47G 9/00

[58] Field of Search ..... 5/248, 248 WB, 370, 5/371, 338

[56] References Cited

UNITED STATES PATENTS

| | | | |
|---|---|---|---|
| 1,738,411 | 12/1929 | Welch | 5/348 R |
| 2,077,233 | 4/1937 | Greenhill | 5/348 R |
| 3,089,153 | 5/1963 | Bosc | 5/348 R |
| 3,602,928 | 9/1971 | Helzer | 5/338 |
| 3,766,579 | 10/1973 | Shields | 5/348 WB |
| 3,900,910 | 8/1975 | Nakata | 5/348 R |

*Primary Examiner*—Werner H. Schroeder
*Assistant Examiner*—Doris L. Troutman
*Attorney, Agent, or Firm*—Stefan J. Klauber

[57] ABSTRACT

A cushioning appliance for supporting patients on wheel, geriatric chairs, or the like. The device includes a generally rectangular air frame, which is defined by a tubular airfilled member which surrounds an open region. A base sheet extends beneath the open region and is secured to the tubular member to define with such member a nesting receptacle for a fluid-containing envelope. The portion of the tubular member which defines the front of the air frame, has a substantially larger cross-section than that of the opposed portion defining the rear side of the frame. In consequence, when a patient is seated upon the appliance, the front-to-rear differential in frame height shifts the weight of the patient rearwardly to aid in stabilization of such patient. The base sheet is preferably secured to the tubular member toward the outer peripheral border thereof. This provides a receiving slot between the lower side of the tubular member and the adjacent portions of the sheet. The envelope may thus have dimensions exceeding that of the open region, so that the peripheral portions of the envelope are received into the said slot. By virtue of this arrangement the envelope may be of sufficient size to enable its separate use. Additionally, the peripheral portions of the envelope are elastically constrained by the slot, to thereby constitute a buffer volume for liquid displaced from the central portion of the envelope in consequence of the patient's sitting upon such central portions, to thereby provide improved cushioning characteristics.

12 Claims, 3 Drawing Figures

WHEEL OR GERIATRICS CHAIR CUSHION

BACKGROUND OF INVENTION

This invention relates generally to cushioning structures, and more specifically relates to a cushioning appliance which has particular application for use with wheel or geriatric chairs.

It has long been known that patients who are confined to wheel chairs, or to geriatric chairs or the like, for extended periods of time, are subject to development of tissue breakdowns, which result in decubitus ulcers — commonly known as bed sores. Partially with the objective of avoiding such ailments, increasing interest has been evidenced in cushions based upon fluid-support principles, i.e. in cushions or similar structures wherein the patient is basically seated upon a fluid-containing envelope. The fluid may comprise air; but preferably a liquid or gel is employed. The basic objective of these types of structures is to introduce a high degree of compliance to the surface upon which the individual is seated, so as to uniformly spread the reaction pressure over an extended area of tissue.

Both in the instances of elderly or enfeebled patients, and in those instances where the patient's medical condition otherwise prevents full or appropriate use of the musculature, the typical prior art structure mentioned, have been less than adequate — in that they failed to take account of the patient's enweakened condition. Such weakened condition, if not properly considered and compensated for, can not only present discomfort for the seated patient; but further, can present genuine danger, especially in that the physical instability of such patients when seated, can readily allow them to fall, or to become improperly displaced forward of the intended seated position.

In accordance with the foregoing, it may be regarded as an object of the present invention, to provide a cushioning appliance for use with wheel, geriatric chairs or the like, which, while based upon fluid-support principles, incorporates structural features enabling proper seating of the patient, and resultant stabilization for the seated patient.

It is a further object of the present invention to provide a cushioning structure for use particularly with wheel, geriatric chairs or the like, which includes structural features enabling a fluid envelope incorporated as a part thereof, to be separately utilized, and which features also prevent gross spillage from the fluid envelope in the event a leak should occur therein.

It is a yet further object of the invention, to provide a cushioning structure or appliance especially adapted for use in wheel or geriatric chairs or other environments wherein enfeebled patients are to be seated, which appliance by providing a buffering volume into which fluid may be expanded and withdrawn during patient movements, adds substantially to the comfort and well-being of the patient.

It is a still additional object of the present invention to provide a cushioning appliance, which while particularly adapted for use with wheel, geriatrics chairs or the like, is also utilizable for cushioning in other environments where comfort and maintenance of good posture are important, including e.g. upon automobile seats or so forth.

SUMMARY OF INVENTION

Now in accordance with the present invention, the foregoing objects, and others as will become apparent in the course of the ensuing specification, are achieved in a cushioning appliance which while particularly adapted for supporting patients confined to wheel, geriatric chairs or the like, may also be utilized in more general applications where comfort, seating stability, and promoting of good posture positions are important considerations.

The device includes a generally rectangular air frame, which is defined by a tubular air-filled member which surrounds an open region. A base sheet extends beneath the open region and is secured to the tubular member, as to define with such member a nesting receptacle for a fluid-containing envelope. The portion of the tubular member which defines the front of the air frame has a substantially larger cross-section than that of the opposed portion — which defines the rear side of said frame. In consequence when the appliance is positioned upon a chair with which it is to be used, and an individual is seated upon same, the front-to-rear differential in frame height tends to shift the weight of the individual toward the rear — to aid in stabilization and proper seating.

The base sheet is preferably secured to the tubular member toward the outer peripheral border of same. This construction provides a receiving slot between the lower side of the tubular member and adjacent portions of the sheet. The fluid-filled envelope may thus have dimensions exceeding that of the open region, with the peripheral border portions of the envelope being received into the said slot. In consequence of this arrangement the envelope can be of sufficient size to enable its separate use. Additionally, the peripheral portions of the envelope are elastically constrained by the slot, to thereby provide a buffer volume for liquid flowing to or from the central portion of the envelope, in consequence of the individual sitting upon the cushion or moving upon same. This facet of the construction thereby provides substantially improved cushioning characteristics, adding both to the comfort and safety of the patient.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
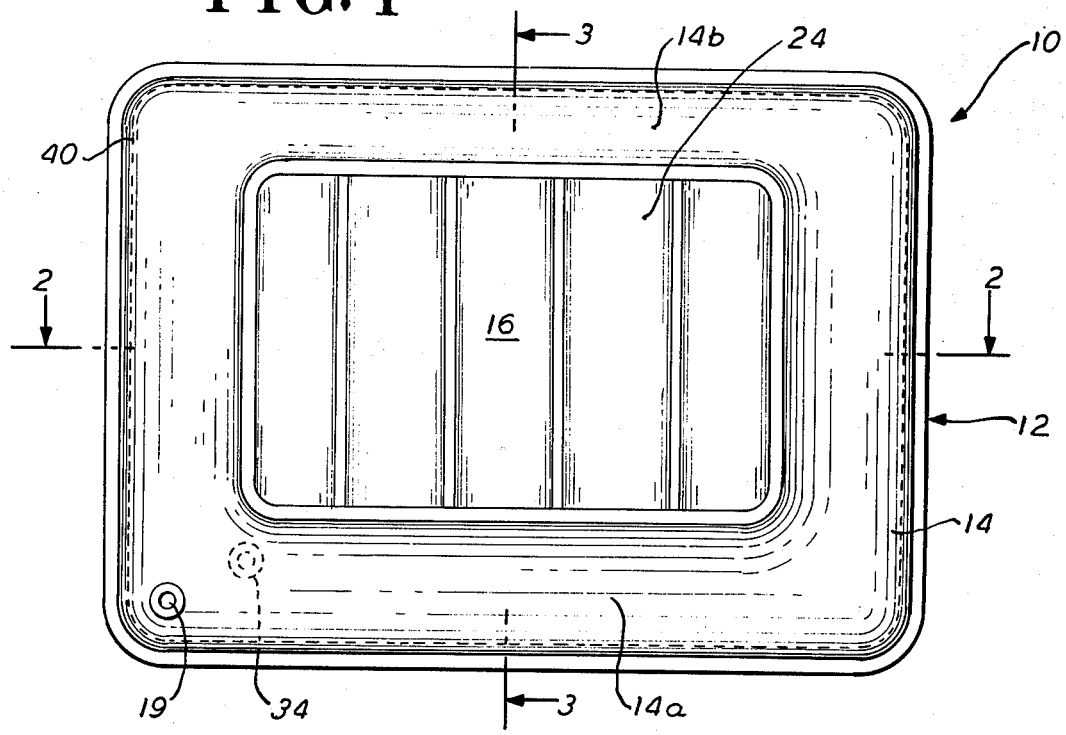
FIG. 1 is a top plan view of a cushioning appliance in accordance with the present invention.

In FIG. 1 herein, a top plan view appears of a cushioning appliance 10 in accordance with the present invention. The view of FIG. 1 may be considered simultaneously with the cross-sectional view of FIGS. 2 and 3, in order to fully appreciate the structure of the present device.

Appliance 10 is seen to consist of a generally rectangular air frame 12, which is defined by a tubular air-filled member 14, which surrounds an open region 16. The tubular member 14 may extend continuously as an open tube about the periphery of the structure, and may be formed from top and bottom pieces 15 and 13 of polyvinyl chloride, or similar tough thermoplastic, which are heat-sealed to one another along their inner and outer lateral edges 18 and 20. The said lateral edges 18 and 20, thus extend completely about the said frame at the inner and outer borders thereof.

The tubular member 12 is collapsible and is normally filled with air through a valve means 19, which is of conventional construction. A typical valve suitable for such purposes is, for example, available from Halkey-Roberts Company of Paramus, N.J., under the product designation "550-AC".

A fluid impervious base sheet 22, which again may comprise a heat-sealable thermoplastic such as the mentioned polyvinyl chloride, extends beneath the open region 16, and is secured to the tubular member about the entire periphery thereof to define with such member a nesting receptacle for a fluid-containing envelope 24. In accordance with one aspect of the present invention, the base sheet 22 is preferably secured to tubular member 14 by sealing the sheet to a portion of tubular member 14 toward the outer peripheral border thereof. Thus, as best seen in the cross-sectional view of FIG. 2, the sheet 22 is preferably secured, as by heat-sealing, to the outer lateral edge 20 of the said tubular member. In consequence of this arrangement it will be clear that a receiving slot 26 is defined between the lower portion 13 of tubular member 14, and the portion 28 of the base sheet 22 which resides between the attachment area at edge 20 and the open region 16. The function of this receiving slot 26, which thus extends completely about and borders the open region 16, will become clear hereinbelow.

Fluid envelope 24, is per se a conventional device, which may comprise upper and lower layers 30 and 32 of a fluid impervious material such as the polyvinyl chloride plastic previously mentioned, which layers are sealed to one another along their lateral edges. Reinforcing ribs 34, as is known in the art, may extend internally between the upper and lower layers 30 and 32, the ribs being heat-sealed to such layers. These ribs, again as is known in the art, do not extend fully across the width of the envelope, so that fluid may readily flow throughout the interior volume of the said envelope.

Like the tubular member 14, the fluid-filled envelope 24 is collapsible, and valve means 34, which again are of conventional construction, are utilized for providing a fluid to or from the interior of the said envelope. The fluid contained in envelope 24 preferably comprises a liquid such as water; but other liquids, including materials of greater or lesser viscosity than water may be utilized; and similarly, other flowable and semi-flowable materials, including gels, slurries, etc., may be used for filling the interior of envelope 24. The valve 34 previously mentioned, may comprise a conventional device, including an auxiliary flapper valve feature, such as the Roberts 10—10 AF valve, available from the aforementioned Halkey-Roberts Company.

Figure 2:
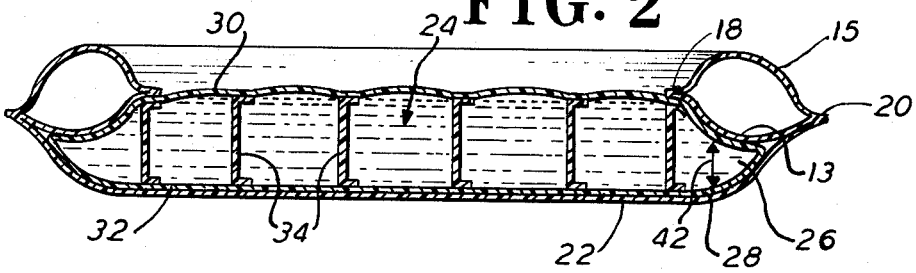
FIG. 2 is a cross-sectional view through the device of FIG. 1, taken along the line 2—2 of the said Figure.
Figure 3:
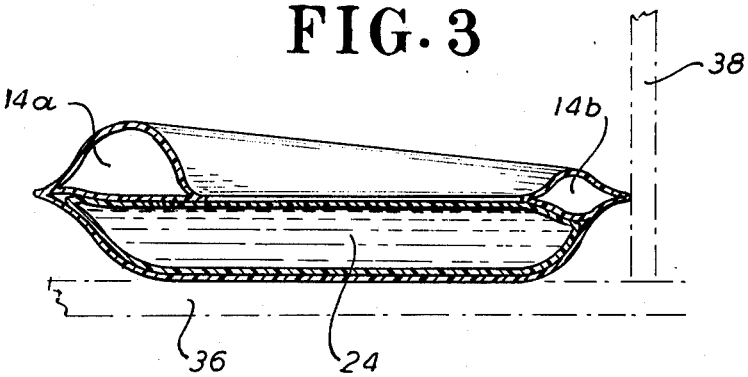
FIG. 3 is a further cross-sectional view of the said device, taken along the line 3—3 of FIG. 1 herein, and depicts schematically how the present construction assists in stabilizing an individual seated thereupon.

By considering the cross-sectional views of FIGS. 2 and 3 herein, the principal attributes of the present invention may now be appreciated. In particular, it will be seen from FIG. 3, that the tubular portion **14*a* of air frame 12, which extends along one rectangular side thereof, is considerably enlarged in cross-section with respect to the cross-section of the opposed portion 14*b* of such air frame. The portion 14*a* may be considered for present purposes as the "front" of the cushioning appliance, and the portion 14*b* as the "rear". It will thus become evident from consideration of FIG. 3, that due to the differential in cross-sections between portions 14*a* and 14*b*, a front-to-rear slope is provided in the present construction. Considering additionally both the cross-sectional view of FIG. 3 and that of FIG. 2, it will be evident that the uppermost reaches of the tubular frame 12 reside well above the uppermost reaches of the fluid-filled envelope 24. In consequence of this arrangement, it will be evident that when the present cushioning appliance is positioned atop a chair seat 36, as for example on a wheel chair, the patient when seated upon the cushion, is automatically stabilized by virtue of his center of gravity being somewhat displaced in a rearward direction, i.e. such center of gravity is displaced toward the back rest 38** of the said chair.

A further aspect of the present invention may now be appreciated. In particular the receiving slot structure 26 previously mentioned, thus assures that the periphery 40 (FIG. 1) of envelope 24, resides well within the said slot, and in particular, well under the bulk of tubular member 14. Several important consequences flow from such arrangement. Among these is the fact that the fluid envelope 24 is firmly positioned and stabilized within the frame 12. A further significant consideration, is that the construction enables use of a fluid envelope 24 having relatively large dimensions. This in turn enables the fluid envelope 24 (which is in no way fixedly secured within the remainder of the appliance) to be removed and utilized (if desired) as a separate cushion in its own right. Were the dimensions of the envelope 24 limited to those of the open region 16, it would be evident that the size of the envelope 24 would be too limited to enable this separate use.

It may, incidentally, be observed that the very fact that fluid envelope 24 is separate from frame 12 and overlies fluid impervious sheet 22, assures that spillage of fluid will not occur from appliance 10 should a leak develop in envelope 24.

A yet more significant advantage of the arrangement indicated, however, is derived from the fact that the portions of fluid envelope 24 held within receiving slot 26, are in effect elastically constrained therein. This is to say that while the top-to-bottom spacing 42 of such portion is constrained by slot 26, it is yet clear that the spacing 42 is quite variable due to the elasticity of the slot boundaries. Accordingly, the lateral constitute a buffer volume, from which and to which, fluid may readily flow from other portions of the envelope.

Thus, in particular, it will be evident that when an individual sits upon the present cushioning appliance, fluid may readily be displaced from the central portions of the fluid envelope 24 toward the buffer volume defined by the lateral portions of the envelope which are within slot 26. Similarly it will be evident, that the elastic constraint present about these lateral portions, tend to cause fluid to flow back into central portions of the envelope when pressure is diminished by the patient shifting his weight, etc. The net effect of this arrangement, is to considerably improve the nature of the cushioning effect provided by the present device, vis-a-vis prior constructions.

While the present invention has been particularly set forth in terms of specific embodiments thereof, it will be understood in view of the present disclosure, that numerous variations upon the invention are now enabled to those skilled in the art, which variations yet reside within the teaching of the invention. Accordingly the invention is to be broadly construed, and limited only by the scope and spirit of the claims now appended hereto.

I claim:

1. A cushioning appliance for supporting individuals on wheel, geriatrics chairs or the like, comprising in combination:

a generally rectangular air frame, defined by a tubular airfilled member surrounding an open region;

a base sheet extending beneath said open region and being secured to said tubular member, to thereby define with said member a nesting receptacle;

a fluid-containing envelope positioned in said nesting receptacle; and the portion of said tubular member defining a first side of said frame, having a substantially enlarged cross-section with respect to the cross-section of the opposed portion of said member defining a second side of said frame, whereby said appliance may be positioned upon said chair with the first side of said frame facing forward of said chair, to thereby shift the weight of an individual seated thereupon rearwardly to stabilize said seated individual wherein said base sheet is secured to said tubular member toward the outer peripheral edge of said frame, to thereby provide a receiving slot defined between the lower side of said tubular member and the adjacent portions of said sheet; and wherein said envelope has dimensions exceeding that of said open region; the peripheral boarder portions of said envelope being received into said receiving slot.

2. A device in accordance with claim 1, wherein both said first and second sides of said frame have uppermost portions above the uppermost portions of said fluid-containing envelope.

3. A device in accordance with claim 1, wherein the said peripheral portions of said envelope are elastically constrained by said slot, said portions thereby providing a buffer volume for volumes of liquid displaced from the portions of said envelope within said open region in consequence of the seating of individual thereupon.

4. A device in accordance with claim 3, wherein said sheet is secured to said frame by heat sealing said sheet to a lateral edge extending along the lateral-most border of said tubular member.

5. A device in accordance with claim 4, wherein both said air frame and said envelope comprise a polyvinyl chloride.

6. An appliance in accordance with claim 2, wherein said envelope contains a liquid.

7. A device in accordance with claim 2, wherein both said frame and said envelope are collapsible, and include valve means for filling same with said air and fluid.

8. A cushioning appliance for supporting individuals upon chairs or the like, comprising in combination:

a generally rectangular air frame, defined by a tubular air-filled member surrounding an open region;

a fluid-impervious base sheet extending beneath said open region and being secured to said tubular member, to thereby define with said member a nesting receptacle;

a fluid-containing envelope positioned in said nesting receptacle; and said base sheet being secured to said tubular member toward the outer peripheral edge of said frame, to thereby provide a receiving slot defined between the lower side of said tubular member and the adjacent portions of said sheet; and wherein said envelope has dimensions exceeding that of said open region; the peripheral border portions of said envelope being received into said receiving slot.

9. A device in accordance with claim 8, wherein the said peripheral portions of said envelope are elastically constrained by said slot, said portions thereby providing a buffer volume for volumes of liquid displaced from the portions of said envelope within said open region in consequence of the seating of individual thereupon.

10. A device in accordance with claim 9, wherein said sheet is secured to said frame by heat sealing said sheet to a lateral edge extending along the lateral-most border of said tubular member.

11. A device in accordance with claim 8, wherein said envelope contains a liquid.

12. A device in accordance with claim 8, wherein both said frame and said envelope are collapsible, and include valve means for filling same with said air and fluid.

* * * * *